United States Patent [19]

Koenig

[11] 3,971,612

[45] July 27, 1976

[54] FLIP-TOP CARTON OF TRUNK TYPE FOR FROZEN ICE CREAM AND COMESTIBLES OF SIMILAR CONSISTENCY

[75] Inventor: Raymond C. Koenig, Wheaton, Ill.

[73] Assignee: Champion International Corporation, Stamford, Conn.

[22] Filed: Sept. 22, 1975

[21] Appl. No.: 615,728

[52] U.S. Cl. ..... 229/37 R; 229/44 R; 229/51 SC

[51] Int. Cl.[2] ..... B65D 5/02; B65D 17/12

[58] Field of Search ..... 229/37 R, 17 R, 44 R, 229/7 R, 48 R, 51 UB, 51 SC

[56] References Cited

UNITED STATES PATENTS

| | | | |
|---|---|---|---|
| 2,104,195 | 1/1938 | Groeling | 229/44 R X |
| 2,760,713 | 8/1956 | Andrews | 229/51 SC |
| 2,983,422 | 5/1961 | Miller, Jr. | 229/17 R |
| 3,017,067 | 1/1962 | Parks | 229/48 R |
| 3,315,870 | 4/1967 | Barnes | 229/37 R |
| 3,316,328 | 1/1968 | Buttery | 229/37 R |
| 3,744,708 | 7/1973 | Gardner et al. | 229/48 R |
| 3,833,165 | 9/1974 | Hoiles | 229/37 R |

*Primary Examiner*—Davis T. Moorhead
*Attorney, Agent, or Firm*—Evelyn M. Sommer

[57] ABSTRACT

Trunk type of carton for encasing frozen ice cream and comestibles of similar consistency formed from a patterned one piece blank of paperboard which has usual flip-top, back, bottom, and front panels successively hinged together by fold lines. Each of these panels has at each end a flap hingedly connected thereto by a fold line, so that when each set of four flaps at either end are overlapped together they are stacked to form a container end closure of first, second, third and fourth end flaps. The bottom panel has each of its end flaps swung upwardly as the first end flap in each end stack with its outermost face being a substantially smooth surface. The folded end flaps of the back and front panels at either container end are lapped in against each other and anchored together over the smooth surface of the first flap. Each of the flip-top panel end flaps which is to constitute the second end flap in each end stack has its free edge opposite its hinged fold line so dimensioned and shaped as to permit the free insertion and swing thereof between the folded first and third end flaps in the stack thereat. The inner side face of each inserted second end flap which is opposed to the substantially smooth outer surface of the first end flap thereat is provided with a plurality of lines of embossments spaced appreciably transversely from each other and extending obliquely in general parallel relation thereacross from the near vicinity of the hinge fold line connection to the adjacent end of the flip-top panel so that carton-opening swing up of the latter with simultaneous swing out of each stack of the second end flap thereof will be a generally facilitated glide of each oblique embossment along the opposed substantially smooth surface of the first end flap in this stack.

5 Claims, 5 Drawing Figures

FLIP-TOP CARTON OF TRUNK TYPE FOR FROZEN ICE CREAM AND COMESTIBLES OF SIMILAR CONSISTENCY

SUMMARY AND BACKGROUND

Prior to the present invention trunk types of cartons provided with flip tops were devised and used in various forms for various purposes, and particularly for the packaging and distribution of highly viscous or stiffly frozen comestibles, such as ice cream. Softening of the carton chamber contents due to rises in temperature or initial deposition therein in the usual thick paste condition created problems of leakage which in turn led to the designing and embodiment of relatively complex features for reducing such leakage tendencies while attempting to avoid undue interference with ready carton opening and access to the contents by the customers. Attempts to overcome other related problems resorted to similar means. For example, the prior art patents of Barnes U.S. Pat. No. 3,315,870 of Apr. 25, 1967; Buttery U.S. Pat. No. 3,361,328 of Jan. 2, 1968; and Hoiles U.S. Pat. No. 3,833,165 of Sept. 3, 1974 are typical.

Barnes U.S. Pat. No. 3,315,870 proposes in such a flip-top carton the provision on certain of the four flaps stacked together to form an end closure provision of closely spaced and parallel short embossments to effect spacings for assuring leveling of lapped flaps so as to assure extended flat surface contact and adhesive coating carried thereby of an overlaid flap and contended resulting liquid tightness of the end closures.

Buttery U.S. Pat. No. 3,361,328 proposes similar provision of groups of adjacent short embossments and debossments in the end flaps that are hinged to the front and back panels to serve purposes similar to those of Barnes whereby leaking is alleged to be prevented.

Hoiles U.S. Pat. No. 3,833,165 proposes the provisions of a pair of short embossments on the inner face of each of the turned up end flaps which are hinged to the ends of the bottom panel that are to be lapped as the fourth flaps on the outsides of the end closure stacks. The marginal side zones of the inner face of each of these fourth flaps are provided with wide ribbons of adhesive to terminate short distances away from the hinge line of this flap to provide there potential leakage spaces, and the short embossments are provided in the latter to extend from the end of each adhesive ribbon to the hinge line to serve as a leakage block or dam.

An object of the present invention is to make efficient use of different embodiments of lines of embossments on the particular infolded flaps hinged to the ends of the flip-top panel which are inserted into the end stack closures to facilitate easy swing up and out thereof with the opening swing up of the top panel for easy access to the contents, and incidentally to serve as effective blockage means for reducing leakage.

The present invention is embodied in a trunk type of flip-top carton formed from a patterned one piece foldable blank of coated paperboard, or the like. This carton blank has a flip-top panel connected along a lateral fold line to a back panel which is, in turn, connected by a similar fold line to a bottom panel that is also connected by another lateral fold line to a front panel. The end edges of the flip-top panel and the two ends of each of the back, bottom and front panels are provided with end flaps hinged thereto by fold lines and are hingedly stackable at each end to form a container havng closed ends. The bottom panel has each of its end flaps swung upwardly as the first end flap in each end stack with its outermost face being a substantially smooth surface, and with the folded end flaps of the back and front panels in each end stack lapped in against each other over the outer face of this upfolded first end flap as the third and fourth end flaps in each stack, and with the latter end flaps anchored together. For the purpose of facilitating swinging down of the flip-top panel to closure of the top of the carton chamber with its end flaps swung inward to general alignment with the bottom panel end flaps as the second end flap in each end stack and slidably inserted by swing between the first end flap and the third and fourth anchored end flaps of each end stack, each of the flip-top panel second end flaps has its free edge opposite its hinged fold line so dimensioned and shaped as to permit such swinging insertion freely. Each of these second end flaps also has its inner side face which is opposed to the substantially smooth side face of the first end flap in each end stack provided with a plurality of lines of embossments spaced appreciably transversely from each other and extending obliquely in generally parallel relation thereacross from the general vicinity of the hinge fold line connection of this second flap toward the adjacent end of the flip-top panel. As a result, the swing out of each end stack of each of these second end flaps will be in the nature of generally longitudinal glide of each oblique embossment along the opposed substantially smooth surface of the first end flap.

Each of these oblique lines of embossment preferably is continuous but, if desired a plurality of relatively short breaks may be provided in each, so that the composite embossed sections together constitute a line of embossment. Each embossment preferably is arched transversely toward the opposed, substantially smooth, outer side face of the first end flap in each end stack for generally line contact therewith. This latter feature assures a minimum of frictional contact between the first and second end flaps so that swing out of the latter relative to the first is facilitated.

It is another object of the present invention further to reduce the degree of frictional contact between the first and second end flaps, particularly during swing of the latter relative to the first, by arranging the oblique lines of embossment along arcs of coaxial circles having their axes commonly located at the fold hinge line of the flip-top panel.

It is to be understood that if any such line of embossment be made up of a plurality of substantially straight line sectors they may be arranged as successive chords of each such circular arc. The anchorage of the third and fourth end flaps in each end stack may advantageously be of a nature as to avoid any necessity for use of adhesive in effecting such anchorage, which may be in the form of complementary parts that are readily engageable together and separable. For example, one of the third and fourth end flaps may have a transverse slot therein and the free end of the other may be shaped as a hook to engage in such slot.

It is a further object of the invention to realize these and other related advantages in economical and reliable manners.

Other objects of the invention will in part be obvious and will in part appear from reference to the following detailed description taken in connection with the accompanying drawings, wherein like numerals identify similar parts throughout, and in which.

Figure 4:
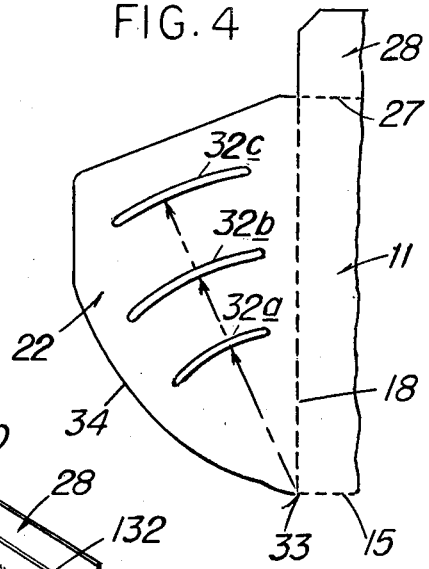
Figure 5:
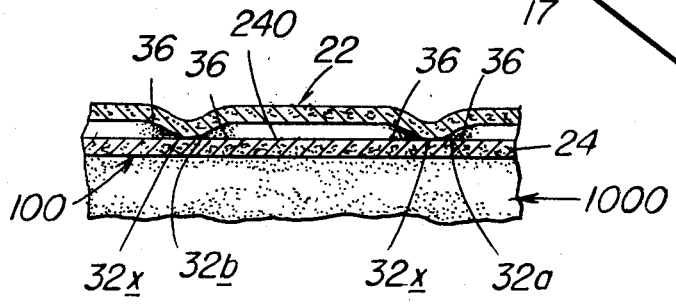

FIG. 4 is a fragmentary plan view, with parts broken away and flattened out into the same plane, of the flip-top panel, its closure lip and the adjacent end flap connected to an end edge of the top panel by a fold line; and FIG. 5 is an enlarged fragmentary sectional view of a portion of the carton chamber, the contents thereof, one of the upwardly bend end flaps that is connected to one end edge of the bottom panel, and one of the end flaps that is connected to an adjacent end edge of the top panel, illustrating the virtual line contact between embossments formed in the latter end flap and the opposed substantially smooth face of the upwardly bend end flap.

Figure 1:
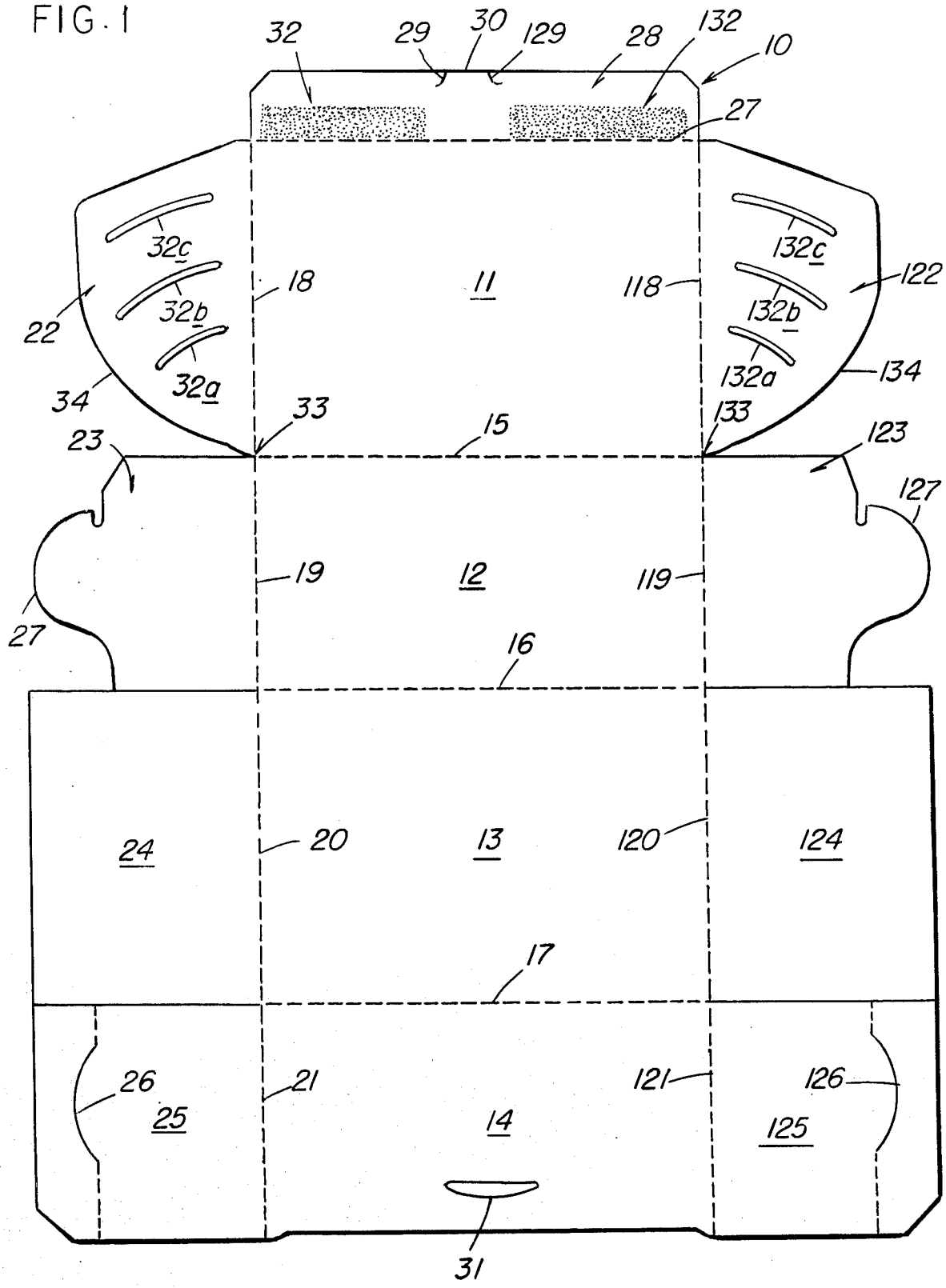
FIG. 1 is a plan view of a one piece blank of paperboard patterned to provide the required flip-top, back, bottom and front panels and the lip which laps the top lateral zone of the front panel for securement thereto, each of these panels being provided at opposite ends with allochirally shaped end flaps.

As will be seen in FIG. 1 there is provided, in accordance with the present invention, a one piece blank 10 of paperboard, which may be coated, and the like, having successively a flip-top panel 11, a back panel 12, a bottom panel 13 and a front panel 14. The top panel 11 is defined from the back panel 12 by a transverse fold line 15, and this back panel 12 is in like manner defined from the bottom panel 13 by a transverse fold line 16. In turn the bottom panel 13 is defined from the front panel 14 by a fold line 17. The opposite ends of the top panel 11 are defined from end flaps by fold lines 18 and 118, and in like manner the back panel 12 is defined at its ends from end flaps by fold lines 19 and 119. Similarly, the ends of bottom panel 13 are defined by fold lines 20 and 120 from end flaps, and the front panel 14 is defined by fold lines 21 and 121 from end flaps. The end flaps which are connected to the ends of the top panel 11 at fold lines 18 and 118 are reversely identical as 22 and 122, with the end flaps which are connected to the ends of the back panel 12 at the fold lines 19 and 119 being in the form of hook flaps 23 and 123. The transverse ends 20 and 120 of the bottom panel 13 are connected by the fold lines thereat to rectangular end flaps 24 and 124, and the ends of the front panel 14 are connected at the fold lines 21 and 121 to the connecting slot end flaps 25 and 125. The latter end flaps are each provided with a severance slot 26 and 126 for engagement respectively therein of hooks 27 and 127 of end flaps 23 and 123.

The flip-top panel 11 has a longitudinal fold line 27 defining its front edge from an integral lip strip 28 which is cut at 29 and 129 to define therebetween an anchorage tab 30 for engagement into a transverse slot 31 in the outer transverse zone of the front panel 14 when the carton parts are set up to define a container. The lip 28 is also provided, preferably adjacent its fold line edge 27, with adhesive-bearing areas 32 and 132 for anchorage to the outer face of the upper transverse zone of the front panel 14 in setting up the blank to contitute a container.

As seen in FIG. 1 each of the end flaps 22 and 122 is provided with a series of substantially spaced and generally parallel lines of embossments. Such embossments **32*a*, 32*b* and 32*c* of flap 22 preferably are arranged along arcs of coaxial circles having their axes commonly located at the meeting point 33 of the transverse fold line 15 and the fold line 18 which defines this flap 22 from the top panel 11. The other end panel 122 is, in like fashion, provided with a series of similar lines of arcuate embossment 132*a*, 132*b* and 132*c* struck about a common center 133 where the transverse and longitudinal fold line 15 and 118 intersect. It will also be seen from FIG. 1 that each of the flip-top end flaps 22 and 122 have their respective free edges 34 and 134 opposite their hinged fold lines 18 and 118** so dimensioned and shaped as to permit a certain free swinging insertion into the end flap stacks as will be explained later.

Figure 2:
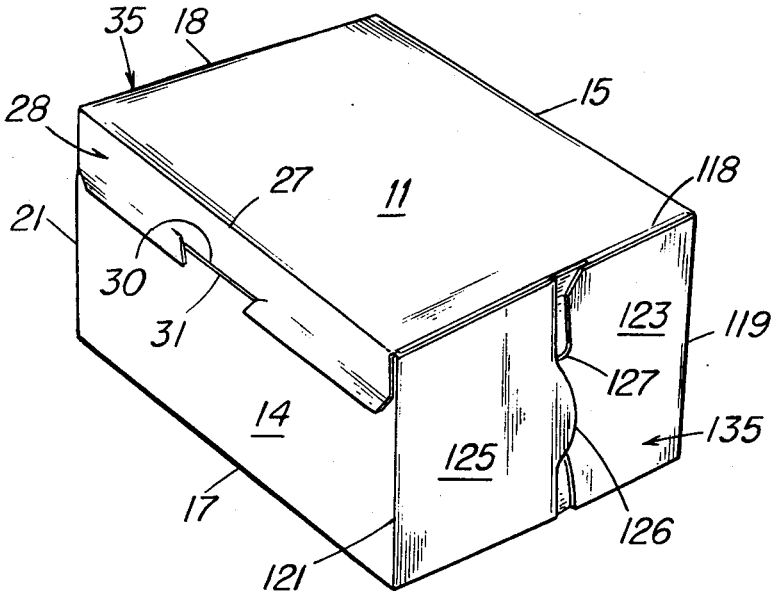
FIG. 2 is a perspective view to smaller scale of a carton set up with the use of the blank of FIG. 1, the parts being bent along score lines provided in the blank and fastened together to define an internal chamber closed by the interengagement and anchorage of the panels and end flaps.

When FIg. 1 blank is properly folded with successive bending along transverse fold lines 15, 16, 17 and 27, and the pairs of end flaps are folded in the following manner to provide end stack carton closures 35 and 135, the resulting structure may constitute a container having a chamber in which the highly viscous or stiffly frozen comestible, such as ice cream, may be housed. For example, the end flaps 24 and 124 hinged respectively to opposite ends of the bottom panel 13 at fold lines 20 and 120 may be considered the first end flaps in the end stacks 35 and 135 since they will be first folded upwardly to constitute the innermost end flaps to such end stacks, as will be best seen in FIG. 3. Next the end flaps 25 and 125, which are connected to the ends of the front panel 14, may be folded back along fold lines 21 and 121 to direct the slots 26 and 126 therein backwardly, as will be noted in FIGS. 2 and 3. The end flaps 23 and 123 which are connected at fold lines 19 and 119 to the back panel 12 will then be bent forwardly to anchor hooks 27 and 127 respectively into the anchorage slots 26 and 126 of end flaps 25 and 125. Thus the end flaps 25 and 125, and 23 and 123, respectively constitute the third and fourth flaps of each of the end stacks.

Figure 3:
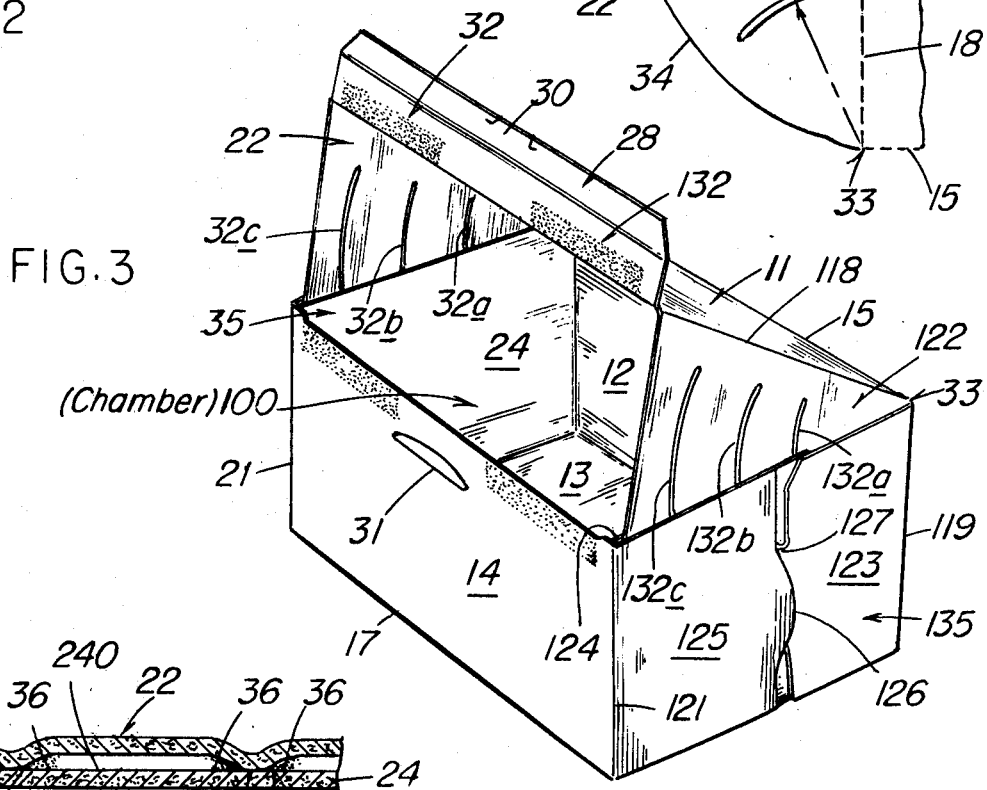
FIG. 3 is a perspective view similar to FIG. 2 but with the lip free from the top zone of the front panel and the flip-top panel swung up to a partially open position and with the carton chamber empty.

The flip-top panel 11 will then have its end flaps 22 and 122 bent substantially at right angles thereto along the fold lines 18 and 118 so that the outer shaped edges 34 and 134 may be inserted into the end stacks between the inner first end flaps 24 and 124 and the anchored outer end flaps 25 and 23, and 125 and 123, all as is indicated in FIG. 3. With complete swing down of the top panel 11 about its transverse hinge defined by fold line 15 the container chamber 100 will be closed, so that the lip 28 may be lapped down against the outer surface of the top zone of the front panel 14 for adhesive anchorage thereto. Thus end flaps 25 and 125, and 23 and 123 constitute respectively the third and fourth end flaps in the end stacks 35 and 135, and the inserted end flaps 22 and 122 constitute the second end flaps of those end flap closure stacks 35 and 135.

It will be understood from FIGS. 3 and 5 that each of the arcuate embossment **32*a*, 32*b* and 32*c*, and also 132*a*, 132*b*, and 132*c*, preferably are transversely arched toward the opposed side face 240 of the first end flap 24 or 124 in each end stack. This will then provide substantial line contact between the crowns of these lines of embossments and the opposed substantially flat and smooth outer face 240 of the first of inner flaps 24 and 124 substantially along lines 32***x* (FIG. 5). This assures appreciable spacing betwen these opposed first and second end flaps and limits their contact substantially to such line contacts, which, by virtue of being arranged on the axis of the circles circumscribed about the axis 33 will facilitate relative gliding motion of such end flap. It will also be seen from FIG. 5 that such embossments may provide by their flanks on opposite sides of such lines of contact useful blocks or dams appreciably to reduce intervening leakage flow that may occur when the thick or pasty content material 1000 is loaded into the carton chamber 100 or, if of the frozen type and it becomes softened during use, storage or when unloading by the consumer, so as to have a consistency which may encourage some leakage. As is indicated in FIG. 5 such minor leakage may collect such as at 36 against the flanks of such contents or arched embossments to be there frozen for minimizing or preventing any such leakage. The freezing of such leaked quantities against the flanks of such embossments will not interfere greatly with swing-opening of the top panel when its lip 28 is freed from its adhesive anchorage, since all that the consumer need to do is invert the carton and reach into each end stack closure with a knife blade along the outer side faces of the inner or first end flaps 24 or 124 and the inner embossed faces of the second or inserted end flaps 22 and 122, easily to free the latter from the former by breaking with ease such frozen adherences.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

Having described my invention, what I claim as new and desire to secure by Letters Patent is the novel subject matter defined in the following claims.

What is claimed is:

1. A trunk type carton formed from a one piece blank of coated paperboard, and the like, and having a flip-top panel for access to highly viscous or stiffly frozen comestible content hingedly connected along a lateral fold line to a back panel, with the latter, a bottom panel and a front panel hingedly connected successively together by similar lateral fold lines; the end edges of said flip-top panel and the two ends of each of said back, bottom and front panels being provided with end flaps hinged thereto by fold lines and hingedly stackable at each end to form a container having closed ends, 1. said bottom panel having each of its end flaps swung upwardly as the first end flap in each end stack with its outermost face being a substantially smooth surface and with the folded end flaps of said back and front panels in each end stack lapped in against each other over the outer face of said upfolded first end flap as the third and fourth end flaps in each stack and with the latter end flaps anchored together;
2. said flip-top panel being swung down to closure of the top of said carton with its end flaps swung inward to general alignment with said bottom panel end flaps as the second end flap in each end stack and slidably inserted by swing between said first end flap and said third and fourth anchored end flaps of this end stack, each of said flip-top panel second end flaps having its free edge opposite its hinged fold line so dimensioned and shaped as to permit such swinging insertion freely;
3. each of said second end flaps also having its inner side face which is opposed to the outer side face of said first end flap in each end stack provided with a plurality of lines of embossments spaced appreciably transversely from each other and extending obliquely in generally parallel relation thereacross from the general vicinity of the hinge fold line connection of this second flap to the adjacent end of said flip-top panel, whereby swing out of each end stack in which each of these second end flaps is associated will be in the nature of generally longitudinal glide of each oblique embossment along the opposed substantially smooth surface of said first end flap.

2. The carton structure of claim 1 characterized by each of said oblique lines of embossments having its ends terminating appreciably short of the marginal edges of said second end flap equipped therewith respectively at the fold hinge line connection to said flip-top panel and the outer free edge.

3. The carton structure of claim 2 characterized by said oblique lines of embossment being arranged along arcs of coaxial circles having their axes commonly located at said fold hinge line of said flip-top panel.

4. The carton structure of claim 3 characterized by said anchorage together of said third and fourth end flaps in each stack thereof being limited to physical interfitting connection of complementary parts which are readily engageable together and separable.

5. The carton structure of claim 3 characterized by each of said lines of embossments being arched transversely toward said opposed side face of said first end flap for generally line contact therewith.

* * * * *